United States Patent [19]

Rothman

[11] 4,078,348

[45] Mar. 14, 1978

[54] CONSTRUCTION PANELS FOR STRUCTURAL SUPPORT SYSTEMS

[76] Inventor: Michael Rothman, 1000 Valley Forge Cir. Apt. 1204, King of Prussia, Pa. 19406

[21] Appl. No.: 733,505

[22] Filed: Oct. 18, 1976

[51] Int. Cl.[2] ..... E04C 2/26

[52] U.S. Cl. ..... 52/309.7; 52/309.11; 52/583; 52/192; 52/310

[58] Field of Search ..... 52/309.4, 309.7, 309.8, 52/309.9, 309.11, 615, 620, 624, 614, 583, 580, 584, 588, 728, 729, DIG. 7; 428/71, 76, 49, 50, 79, 192, 310, 315, 317, 320, 322

[56] References Cited

U.S. PATENT DOCUMENTS

| | | | |
|---|---|---|---|
| 3,122,860 | 3/1964 | Schulze | 52/615 |
| 3,898,115 | 8/1975 | Watkins | 52/309.16 |
| 3,905,167 | 9/1975 | Watkins | 52/309.9 |
| 3,989,562 | 11/1976 | Hiadik | 428/71 |

FOREIGN PATENT DOCUMENTS

| | | | |
|---|---|---|---|
| 1,190,872 | 10/1959 | France | 52/620 |
| 1,393,357 | 2/1965 | France | 52/615 |
| 557,929 | 1/1975 | Switzerland | 52/309 |
| 982,115 | 2/1965 | United Kingdom | 52/584 |

*Primary Examiner*—John E. Murtagh
*Attorney, Agent, or Firm*—Seidel, Gonda & Goldhammer

[57] ABSTRACT

A construction panel is provided comprising a core of expanded or foamed polymeric material embodied between two major face members of resin reinforced with glass fibers. The side walls of the panel comprise pultrusion angle members which are encapsulated in the panel within the major face members. Elongated U-shaped pultrusion reinforcing members may be disposed within the panel to provide reinforcement and a channel for the receipt of wires, pipes, or to act as heating, air conditioning or vacuum cleaning ducts. The glass fibers used to reinforce the major face members are in multidirectional orientation and have portions extending into the interior of the panel to provide a mechanical and chemical bond between the core and the major face members. The pultrusion members may be made from resin reinforced with continuous strands of glass fibers in unidirectional orientation, and are preferably prestressed.

13 Claims, 5 Drawing Figures

CONSTRUCTION PANELS FOR STRUCTURAL SUPPORT SYSTEMS

BACKGROUND OF THE INVENTION

This invention relates to construction panels for structural support systems having high strength to weight ratios and excellent insulating properties. The construction panels may be used to build walls, floors, roofs, exterior fascia panels, facades, curtain walls, spandrels, balcony dividers, interior partitions, ceilings, etc. for industrial, commercial and residential buildings.

Traditionally, buildings have been constructed from a wide variety of materials. Among the more common are wood, cinder block, brick, concrete, metal, and glass. Each has particular advantages and disadvantages. Wood, while relatively easy to work with, is quite flammable, requires the labor of skilled carpenters who take a long time in constructing an entire building, and is becoming increasingly expensive. Cinder block and brick are both quite heavy, resulting in high transportation costs and require the work of skilled masons over a long period of time to construct a building therefrom. Concrete is difficult to transport, fairly expensive and requires the use of special techniques and equipment, in order to produce a building therefrom. Metal panels are not good insulators and require the services of welders, riveters or other personnel to fasten the panels together and to the supporting structure by bolts, rivets or the like. Glass is breakable, hard to transport and is not a good insulator. Because of these disadvantages, new materials have been and are being developed to replace the traditional building materials.

There is an increasing awareness that the world's natural resources must be conserved for future generations. The importance of adequately insulating buildings has been stressed by government and private industry alike. By properly insulating a building, consumers of energy used to heat and cool the building may save money, while at the same time aiding to conserve natural resources. In addition, by reducing energy demands to heat and cool our homes, offices, factories and the like, the citizens of the U.S. can help reduce our country's dependence on imported oil and natural gas.

Various methods of insulating buildings have been proposed. Rolls of insulating material having various degrees of thicknesses may be purchased and unrolled at the job site adjacent the wall, floor, and roof members to be insulated. For pre-constructed structures, insulating material may be blown between the outer facing and the inner walls of a building to the desired density.

Another technique of providing adequate insulation for buildings is to incorporate insulating material in prefabricated building panels. These panels offer the advantages of good insulating properties, mass production, and ease of on-site assembly of the panels, among others. These panels generally comprise a core of insulating material surrounded by structurally rigid panels. The core of insulating material may comprise balsa wood, glass wool, foamed or expanded polymeric materials such as polystyrene, polyvinyl chloride, polyurethane, etc. The core material may be surrounded by panel members comprising first and second major face members and side and end walls of such materials as plywood, metal, resin, and resin reinforced with fibrous glass rovings, etc. Generally, these panels are strong, lightweight and provide excellent insulating properties.

These modular panels also have some disadvantages. Since the foam used in forming the core is not elastic, once it is compressed, a space develops between the core and facing member. This results in weakened structural integrity and may be responsible for such conditions as warping, buckling and cracking of the face member or of the entire panel. An additional advantage is that the major face members generally cannot withstand a great amount of load bearing pressure as may be encountered when the panels are used as part of a floor or, in some climates, a roof. To make the panels stronger, various reinforcing means have been incorporated within them. The following patents are representative of the way in which the prior art has attempted to overcome the problems and disadvantages associated with foamed core sandwich-type panels.

Boyer, in U.S. Pat. No. 2,376,653, discloses a laminated panel comprising a thermoset resin containing reinforcing materials such as sisal, cocoanut shell fibers, wood excelsior, etc. bonded between two fibrous sheets. Spacers of wood or synthetic thermoset resin are placed between the inner surfaces of the spaced sheets to offset any tendency of the panel to buckle or warp.

Shwayder, in U.S. Pat. No. 2,880,473, discloses a fibrous glass lamination comprising a core of hard rigid material, such as Masonite, kraft paper, heavy carboard, sheet steel, etc., encased within a thin skin of bibrous glass which acts to resist the tension of bending forces upon the laminate. Reinforcing bars or tubes may be located within the inner layer. Other embodiments show reinforcing bars extending from the inner surface of the fibrous glass coating out of the laminate. The reinforcing bars or tubes extending from the face of the laminate are parallel to each other so that one laminate may be interlocked with another laminate.

Weinrott, in U.S. Pat. No. 3,462,897, discloses a panel structure comprising a frame made of wood to which are attached outer skins made of plywood or asbestos. Urethane foam is injected under pressure and heat into the cavities formed by the skins and the frame to form a core which adheres to all of the surfaces in contact therewith so that the resultant panel structure is a stressed skin structure. The panels may be used for walls, floors, or roofs and are particularly adapted for onsite assembly into a building.

Andersen, in U.S. Pat. No. 3,573,144, discloses a sandwich-type structural panel wherein face sheets of woven glass cloths impregnated with an epoxy or polyester resin are bonded to a core. The core comprises a plurality of spacer blocks made of balsa wood or foamed polymeric material. The spacer blocks are connected to each other by undulating strips of resin impregnated fibrous webs, wherein the fiber is glass fiber or other natural or synthetic, organic or inorganic material. Reinforcing strips of the same type of resin impregnated fibrous material may be placed between adjacent spacer blocks to further strengthen the panel.

Payne, in U.S. Pat. No. 3,733,232, discloses a composite building panel wherein a variety of base sheet materials, such as sheet steel, plaster board, asbestos felt or the like, may be combined with outer facing sheets of metal or other suitable material by means of a foamed or expanded plastic core. The facing sheet is preferably corrugated and the foamed plastic material may be foamed polyurethane.

Allard, in U.S. Pat. No. 3,791,912, discloses a sandwich-type construction panel wherein reinforcing bars of metal are placed between a foam core and covering material comprising resin incorporated with glass fibers. The core or body is formed from an extruded block of foamed polymeric material, such as polyvinyl chloride or polyurethane. The core or body of foamed polymeric material has grooves cut into its surface according to the dimensions of the metal reinforcing bars, such as those used in reinforced concrete construction, but these are not prestressed. The resin coating includes flexible glass fibers disposed in several layers within the resin covering. The resin covering is applied to the core or body such that the metal reinforcing rods are between the core and the resin covering. Allard also discloses several other embodiments of building panels based on the concept of using metal reinforcing rods with foamed polymeric material sandwich-type structures.

Watkins et al., in U.S. Pat. No. 3,898,115, disclose a sandwich-type building panel comprising a sheath of resin reinforced with glass fibers filled with a self-foaming polyurethane which forms the inner core. Voids may be left within the inner core to provide for channels for electrical wiring, water pipes or air conduits. In an alternate embodiment, the core is W-shaped. A plurality of triangular foam blocks are placed between two mats of woven glass fibers. The top mat is stitched to the bottom mat adjacent the base of each foam block and covers the apex of the foam blocks. Another layer of oppositely disposed triangular foam blocks are placed on top of the second layer immediately after the second mat has been sprayed or impregnated with a resin. A third mat of woven glass fibers is placed over the second layers of blocks and impregnated with resin. The entire core structure is then sandwiched between two sheets of resin impregnated with glass fibers. In either of the embodiments, the panels may be joined together along their coacting edges by means of a plurality of bolts, rivets or other fasteners through holes in flanges formed in the edges of the panels.

Johnson, in U.S. Pat. No. 3,920,871, discloses a structural element particularly suitable for forming curved structures, such as boat hulls. The structural element comprises parallel rows of alternately oppositely undulated bundles of glass fiber rovings which are woven over and under adjacent parallel foamed plastic slats. The rovings are loosely woven so that there are spaces between the adjacent foamed plastic slats to allow for curvature of the structural element. Face sheets of woven glass fibers or other woven materials are placed on either side of the structure. A settable resin is then used to impregnate the woven structural elements so that all voids between the woven rovings, the woven face sheets and the foamed plastic slats are filled with the settable resin. The impregnation of the structural element with the settable resin produces upon setting "I-beams" of resin between the foamed plastic slats and provides a surface coating of resin which is integral with the "I-beams", to provide a strong, rigid, unitary structure.

SUMMARY OF THE INVENTION

The present invention overcomes the structural deficiencies of the prior art, including the defiencies associated with the above-described patents. The present invention provides for contruction panels for structural support systems comprising a core of extended polymeric material embodied between first and second major face members made of resin reinforced with glass fibers having increased load-bearing characteristics when compared with prior art panels. The resin used to make the major face members is reinforced with glass fibers in multidirectional orientation for multidirectional stability and strength. Some fibers extend into the interior of the panel so that a mechanical, as well as chemical bond is formed between the core and the major face members when the core is foamed in situ.

The panels of the present invention have side walls comprising pultrusion angle members encapsulated within and/or bonded to the major face members. If necessary, one or a plurality of pultrusion reinforcing members are disposed within the panel between the major face members and bonded to the major face members. The pultrusion angle members forming the side walls of the panel and the pultrusion reinforcing members are made of resin reinforced with continuous strands of glass fibers in unidirectional orientation. The glass fiber strands are placed under tension as the resin cures to form prestressed pultrusion members. These prestressed pultrusion members provide the panels with increased structural strength, longitudinally and vertically.

The pultrusion angle members which form the sides of the panel have a portion extending beyond the plane of one of the major face members of the panel to provide a flange for the interconnection of the panel members in abutting relationship by the use of fastening means to fasten the flanges together.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

Figure 1:
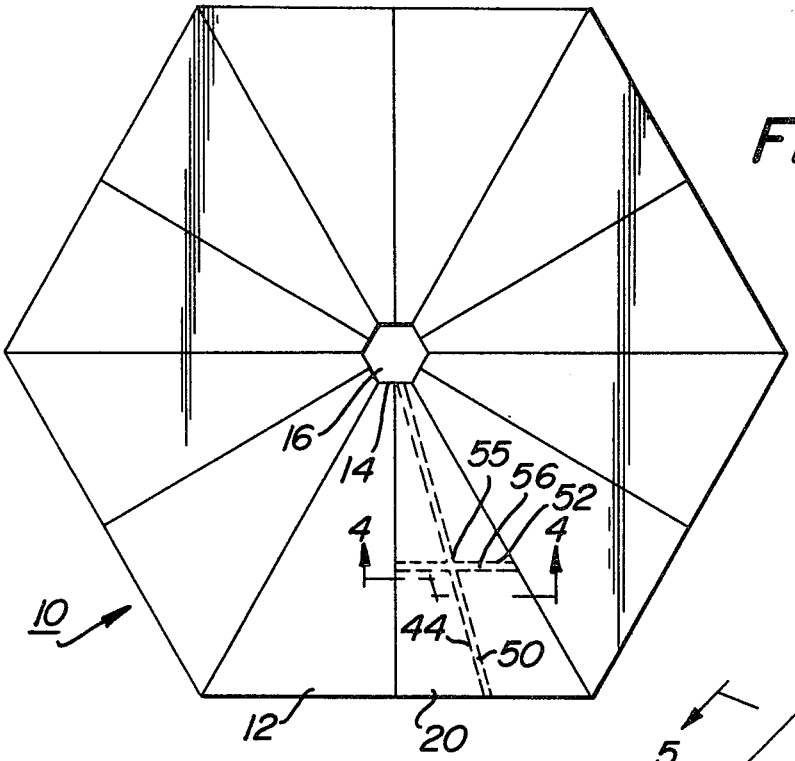
FIG. 1 is a plan view of a floor or roof formed from panels according to the present invention.
Figure 2:
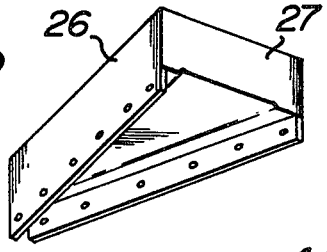
FIG. 2 is a perspective view, not to scale, of a triangular panel according to the present invention used to make floors, roofs, and other load supporting structures.
Figure 3:
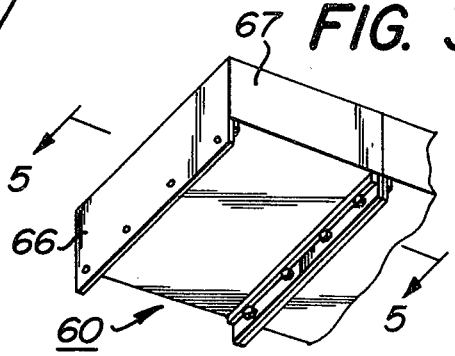
FIG. 3 is a perspective view, not to scale, of connected rectangular panels according to the present invention used to make walls and other non-load supporting structures.

Referring to the drawings in detail, wherein like numerals indicate like elements, there is shown in FIG. 1 a floor or other load-bearing structure 10 made of a plurality of panels 12 and 20 according to the present invention. Although load-bearing structure 10 is shown as a hexagonal structure, it could be rectangular, circular or any other desired shape, as could each of the individual panels.

The term "load bearing" refers to panels and structures which generally have loads bearing on their major face members, that is, the panels or structures are generally placed so that major face members are horizontal. The term "non-load bearing" refers to panels and structures which generally support loads on their edges or sides, rather than on their major face members.

Panel 12 is a left-hand triangular-shaped construction panel having angles of 30°, 60° and 90°. Panel 12 is conveniently denominated a left-hand panel since as shown in FIG. 1, panel 12 is to the left of panel 20. Right angle triangular panels 12 and 20 are substantially mirror images of one another and are fastened together in edge abutting relationship along the sides of the triangle between the right angle and the 30° angle by means discussed below.

The dimensions of the panels will depend upon the load design characteristics to which the panels will be subject in use. For example, the live load value for floors and, in some climates, roofs, is about 40 pounds per square foot for residential buildings. The live load value for walls and some roofs in residential buildings is about 30 pounds per square foot. These values are compared with commercial and industrial structures having a live load value of about 55 pounds per square foot and a live load value of about 40 pounds per square foot. The load design strength of the panels can be engineered and adjusted by encapsulating within the panels reinforcing member 44 and 52, best seen in FIGS. 1 and 4.

The preferred lengths of the sides of the triangular panel are about 12 feet, 21 feet and 24 feet when the panels are used for a floor. When the panels are used for a roof, because of the pitch required, the preferred lengths of the sides are 12 feet, 23 feet and 26 feet. The length of the sides of the rectangular panels are about 8 feet and 12 feet. Both the triangular panels and the rectangular panels can have a thickness of from about 2 and 5/16 inches to 5 and 5/16 inches, not including the depending flanges, depending on the thickness of the foamed core. The presently preferred thickness is about 3 and 5/16 inches, not including the depending flanges. The triangular panels may be truncated as indicated at 14 in FIG. 1 to produce a central opening 16 for the running of pipes, electrical wires, heating and air conditioning ducts, telephone cables, antenna wires and the like.

The internal structure of a panel used to bear heavy design loads will be described with particular reference to FIG. 4. Panel 20 comprises a first major face member 22 and a second major face member 24, both made of thermoplastic or thermoset resin reinforced with glass fibers.

The particular type of resin used to make the major face members of the panels depends upon the environment and uses of the structure assembled from the panels. Thermoset resins become hard when heated. Thermoplastic resins become soft when heated and harden upon cooling. Among the suitable thermoplastic resins are the following: polystyrene, nylon, polycarbonate, styrene-acrylonitrile, acrylics, vinyls, acetals, polyethylene, fluorocarbons, polyphenylene oxide, polypropylene and polysulfone. Among these, the preferred thermoplastics are polyethylene and polypropylene. Suitable thermoset resins include polyesters, epoxies, phenolics, silicones, melamines and diallyl phthalate. Among the thermoset resins, polyesters and epoxies are preferred.

Polyester resins are presently the most preferable for use with the present invention. Polyester resins are the polycondensation products of dicarboxylic acids, such as maleic, fumaric, phthalic and adipic acids, among others, with dihydroxy alcohols, such as ethylene, propylene, diethylene, and dipropylene glycols, among others. This resin is particularly preferred because of its ability, when catalyzed, to cure or harden at room temperature under little or no pressure. Unsaturated polyesters are usually crosslinked through their double bonds with a compatible monomer which also contains ethylenic unsaturation, such as styrene and diallyl phthlate, to become thermosetting.

Various additives can be incorporated into the resin in addition to the glass fibers. Among these are pigments in almost any color, flame retardants, mold release agents and low shrink and low profile additives, usually thermoplastic resins added to the polyester to give low shrinkage and minimum surface waviness to eliminate or minimize the need for post-mold processing.

The glass fibers are incorporated in multidirectional orientation in the resin used to make the major face members. By providing for a multidirectional fiber orientation, the major face members have essentially equal strength in all directions. Multidirectional fiber orientation is obtained by using chopped strands or mats woven from continuous or chopped strands. In the present invention, because of economy and ease of application, the use of chopped strands is preferred. The chopped strands are conveniently applied by spraying them onto a layer of resin which previously has been applied to a mold.

When the fibers are in multidirectional orientation, the fibers can be incorporated within the resin up to about 50% by weight of the total resin-glass fiber composite. As used in the present specification and in the appended claims, the term "percent" refers to the weight percent based on the total weight of the resin-glass fiber composite.

When the glass fibers are in multidirectional orientation, the resin-glass fiber composite may contain from about 10% to about 50% reinforcing glass fibers. The presently preferred percentage of reinforcing glass fibers is about 25%. With this amount of reinforcing fibers, a good balance is achieved between the required load bearing strength encountered in the construction industry and economy. The exact amounts of reinforcing fibers present in the resin-glass fiber composite used for the major face members of the panel depends on the particular resin used, the strength required and the expense of the materials.

The chopped strands should be applied to the interior sides of the first and second major face members such that the strands extend from the surface of the resin-glass fiber composite into the panel as illustrated at 23 and 25 in FIG. 4, for a purpose to be described below.

The panels used for the load bearing surfaces, such as the floor of a building, have side walls 26 and preferably include reinforcing members 44 and 52.

The side walls comprise F-shaped pultrusion angle members. Since both are substantially identical in structure, only one will be described. Each F-shaped pultrusion angle member comprises a portion 28 which extends below the plane of second major face member 24, a top horizontal flange 30 and a bottom horizontal flange 32. Top flange 30 is preferably longer than bottom flange 32 because first major face member 22 generally supports more of a load than second major face member 24. Pultrusion angle member 26 is encapsulated within the panel by having its top horizontal flange surrounded by and bonded to encapsulating portion 40 of the first major face member and having bottom horizontal flange 32 surrounded by and bonded to encapsulating portion 42 of the second major face member. By encapsulating the side walls in portions of the first and second major face members, an extremely strong structural panel may be obtained which resists separation of the major face members from the side walls.

The side walls are referred to as "pultrusion" angle members because they are formed by a pultrusion process. The process of pultrusion is analogous to the process of extrusion. In extreusion, a plastic material is pushed through a die having a particular shape to form a product whose cross section has the shape if the die. In the process of pultrusion, and more particularly, continuous pultrusion, a plastic mass is pulled through a forming die to produce a pultrusion having a cross section corresponding to the shape of the die. There is no practical limit to the length of stock produced by continuous pultrusion, so long as the source of plastic material is continually replenished.

Figure 4:
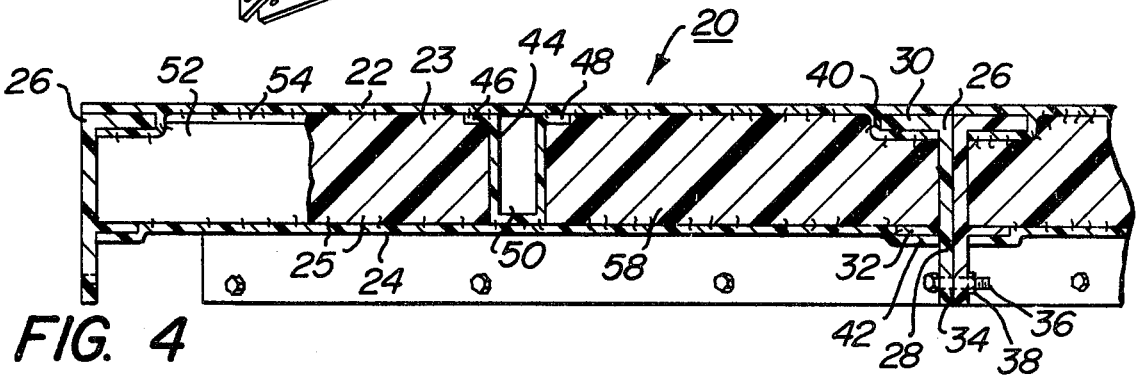
FIG. 4 is a sectional view of connected triangular panels according to the present invention, taken along line 4—4 of FIG. 1.
Figure 5:
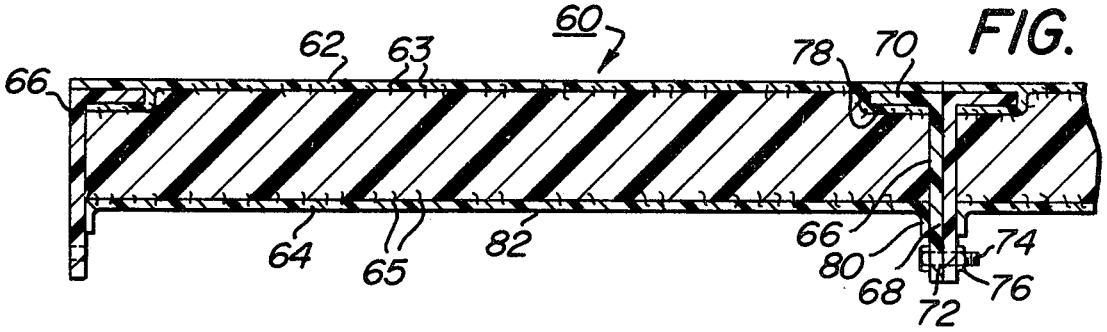
FIG. 5 is a sectional view of connected rectangular panels taken along line 5—5 of FIG. 3.

The F-shaped pultrusion angle member forming the side walls of the embodiment of the present invention shown in FIG. 4 are formed by pulling a resin through an F-shaped die. The resin used for the pultrusion angle members may be the same as or different than the resins used in forming the first and second major faces of the panel, so long as the resin chosen for the pultrusion angle members is compatible with the resin chosen for the first and second major face members so that the encapsulation of the pultrusion angle members in the major face members is not inhibited. Polyester resins are the presently preferred resins for forming the pultrusion angle members.

A major advantage of using pultrusion angle members to form the side walls as compared to side walls formed by other processes, is that the resins may be reinforced readily with continuous strands of glass fibers. Continuous strands of glass fiber roving are impregnated in a resin bath and are then pulled through an F-shaped die. A portion of the die may be heated to initiate the cure when using a thermoset resin. The cure may be completed by pulling the partially formed F-shaped pultrusion angle member through an oven.

Preferably, the fibers of the continous strand or strands of glass fiber roving are in unidirectional orientation. This provides the greatest longitudinal strength in the direction of the fibers. Very high strengths are possible due to high fiber concentration and orientation parallel to the length of the stock being pulled through the die. By using a resin reinforced with continuous strand roving, a resin-glass fiber composite may contain up to 80% of reinforcing fibers if they are in unidirectional orientation.

By subjecting the continuous strands to additional tension while the pultrusion angle members are being formed, the pultrusion angle members become prestressed. It is particularly preferable in the present invention to have the side walls of the panels formed from pultrusion angle members made from polyester resin reinforced with continuous strands of glass fibers in unidirectional orientation wherein the pultrusion angle members have been prestressed during formation.

For large panels, especially those used for the load bearing structures, such as floors and in some instances, roofs, reinforcing members may be disposed between the two major face members within the panel. As shon in FIGS. 1 and 4, panel 20 contains two elongated reinforcing member 44 and 52. Preferably, the elongated reinforcing members are U-shaped in cross section to form channel members 50 and 56 within the panel. Elongated reinforcing member 44 has horizontal flanges 46 and 48 integral with the uppermost portions of its side walls forming the U. Elongated U-shaped reinforcing member 52 likewise has horizontal flanges 54 (only one of which is shown in FIG. 4) integral with the upper portions of its side walls. The flanges help to distribute the weight supported by the panel and provide greater surface area for a stronger bond between the interior of first major face member 22 with the top portion of the flanges so as to allow reinforcing member 44 to be more strongly bonded within the panel.

Reinforcing member 44 is disposed within the panel lengthwise for substantially the entire length of the panel, about in the middle, widthwise, of the panel. Reinforcing member 52 is disposed within the panel widthwise for substantially the entire width of the panel and may intersect reinforcing member 44 at any angle, but preferable at substantially 90. If desired, the walls of one of the reinforcing members may be eliminated at the point of intersection of the two members to provide an intersection passageway 55 between channels 50 and 56. The walls of channels 50 and 56 should be bonded together at intersection passageway 55.

Channels 50 and 56 may contain electrical wires, water pipes, gas pipes, television and radio antenna cables, telephone wiring, alarm system wiring, etc. Alternatively, because the U-shaped elongated reinforcing members are bonded to the interior surfaces of major face members 22 and 24, and to each other at intersection passageway 55, channels 50 and 56 may be used for fluid conduits, such as heating ducts, air conditioning ducts, vacuum cleaning system passageways, or the like. When using channels 50 and 56 as conduits, there is no need to line them with any other materials.

The reinforcing members may be made by the same process used to make the pultrusion angle members forming the side walls of the panel. Thus, it is proper to refer to reinforcing members 44 and 54 as pultrusion reinforcing members. They may be formed from polyester resin reinforced with continuous strands of glass fibers in unidirectional orientation for greater strength along their length. The number and placement of the reinforcing members within the panel is optional and may be determined on the basis of strength and cost factors. The thickness and shape of the reinforcing members obviously determine their strength and their cost.

End walls 27 of triangular panel 20 and end walls 67 of rectangular panel 60 may be either pultrusion angle members similar or identical in structure to side walls 26 and 66. Alternatively, and preferably for most cases, end walls 27 and 67 comprise a resin-glass fiber composite wherein the glass fibers are in multidirectional orientation similar or identical to the composite used to form the first and second major face members of the panels. Holes aligned with channels 50 and 56 may be cut into the side walls or the end walls of the panels to provide access to the channels. In some instances, it will be unnecessary to form end walls for the panels, such as truncated portion 14 of triangular panel 20.

An insulating core is formed within the panel by causing an insulating material 58 to fill completely the interior of the panel, except in the channels formed within the reinforcing members, if any are present.

The insulation is preferably an expanded or foamed polymeric material. Suitable polymeric materials include foamed polyethylene, foamed polypropylene, foamed polystyrene, foamed epoxy resins, foamed cellulose acetate resins, foamed phenolic resins, foamed ABS resins and other foamed polymers. The foamed core should have a density of at least 4 pounds per cubic foot so as to resist being compressed, and thus be highly resistant to delamination. A density of 4 pounds per cubic foot has been found to produce the optimal combination of thermal and mechanical properties. The density of the foamed core may be determined for the maximum load bearing requirements, thermal and sound insulating characteristics and cost for a particular structure. The preferred thickness of the foamed core is between about 3 to 5 inches, with 3 inches being the presently preferred thickness.

Expanded or foamed polyurethane is particularly preferred. The polyurethane is preferably foamed in situ within the pannel. A polyol, such as polypropylene glycol is treated with a diisocyanate in the presence of some water and a catalyst, such as amines, tin soaps, or organic tin compounds. As the polymer forms, the water reacts with the isocyanate groups to cause cross linking and also produces carbon dioxide which causes foaming. Alternatively, trifluoromethane or a similar volatile material may be used as a blowing agent. The foaming is conducted within the panel under pressure so that the polyurethane foam fills the entire interior of the panel except for the channels. If the polyurethane foaming reaction is begun before the polyester resin completely cures, some cross linking may occur to create a chemical bond between the polyurethane and the polyester resin on the interior of the major face members of the panel. An uncured polyester resin may be placed on the interior surfaces of the pultrusion angle members and the pultrusion reinforcing members to create this chemical bond.

As best shown in FIG. 4, the polyurethane also forms a mechanical bond with glass fibers 23 and 25 extending from the interior surfaces of major face members 22 and 24. The final coating of resin and glass fibers on the interior of major face members 22 and 24 is deliberately left unrolled so that glass fibers 23 and 25 may combine with the polyurethane foam to create a stronger bond without the use of any glue or other adhesive. The combined mechanical and chemical bonds provide a laminated panel having a synergistic strength greater than the combined stength and rigidity of the individual components.

Building panels 20 may be joined together along their coacting side walls to form a common unitary structure such as a floor or roof. Preferably, adhesive such as polyester resin is coated on the side walls before they are fastened together. They may be fastened together mechanically by means of a plurality of bolts 36 and nuts 38 which extend through holes 34 in side wall portion 28 extending below the plane of the second major face member. The panels may be bonded to wall structures, foundations, ceilings, etc. by means of an adhesive such as polyester resin and suitable mechanical fastening means, if desired.

Panels used in forming walls and other non-load bearing structures need not, and preferably do not contain pultrusion reinforcing members. The building panels used for these structures may be any shape. For the purposes of illustration and explanation, a rectangular panel 60 will be described.

Rectangular panel 60 may be made of the same materials as triangular panel 20. Therefore, a detailed description of the various components will not be given in relation to panel 60. Panel 60 comprises a first and second major face members 62 and 64 made of a resin-glass fiber composite having glass fibers 63 and 65 extending into the interior of the panel. The glass fibers used to reinforce facing members 62 and 64 are in multidirectional orientation. L-shaped pultrusion angle members 66 form the side walls of panel 60. F-shaped fultrusion angle members may be used when greater strength is desired. Each pultrusion angle member 66 has a top horizontal flange 70 and a portion 68 extending below the plane of the second major face member. Each pultrusion angle member 66 is encapsulated within the panel by being encapsulated within first major face member 62 by encapsulating portion 78 and bonded to or encapsulated within second facing member 64 by encapsulating portion 80. Insulating material 82, preferably polyurethane foam, is disposed within the interior of the panel and is bonded to major face members 62 and 64 by a chemical and mechanical bond.

Non-load bearing panels 60 are joined together along coacting side walls by means of an adhesive such as polyester resin and mechanical means, such as bolt 74 which extends through adjacent aligned holes 72 in adjacent lower portions of pultrusion angle members forming the side walls of the panels. A nut 76 is secured to each bolt 74.

The preferred process for forming the panels will now be described.

A female mold made of wood, metal, resin reinforced with glass fibers, or the like, is coated with any conventional release agent compatible with the mold and the resin chosen for the panel. A gel coat of resin is then spread onto the release coating. Glass fibers in multidirectional orientation are distributed onto the gel coat, preferably by spraying, but other methods, including hand lay-up of continuous and chopped strand mats may be employed. The glass fibers may be rolled into the resin so as to be completely surrounded by the resin. These steps are repeated until a first major face member of desired thickness is formed. In the last application, the glass fibers are left unrolled so as to be able to extend into the interior of the panel.

Previously prepared pultrusion angle members and, if desired, pultrusion reinforcing members are then placed within the mold and encapsulated within the resin-glass fiber composite before the composite has cured. The first major face member with the encapsulated side walls and bonded pultrusion reinforcing members is then allowed to at least partially cure.

Simultaneously with the formation of the first major face member, a male mold is similarly coated with a release agent and several layers of resin and glass fibers to the desired thickness and allowed at least partially cure. Then either mold is inverted and mated onto the other mold so that the pultrusion angle members are encapsulated within the second major face member and pultrusion reinforcing member, if any, is bonded to the second major face member If desired, end walls may be formed either of pultrusion angle members or of resin-glass fiber composite. The end walls may be formed at the same time that the first major face member is formed or when the pultrusion angle members are encapsulated within the first major face member. The end walls are bonded to the side walls and to the first and second major face member.

Before the final end wall is completely formed, liquid polyurethane is introduecd into the interior portions of the panel and allowed to expand or foam, preferably under pressure, so that the insulation completely fills the interior of the panel. As pointed out above, by foaming the polymeric material before the resin of the first and second major face members is completely cured, a mechanical and chemical bond is formed between the foam core and the face members. After the foaming process is complete and the resin-glass fiber composite is completely cured, the panel is removed from the molds and a plurality of holes are drilled in the portions of the side walls extending below the plane of the second major face member. Of course, during the formation process, openings for windows, doors, archways and the like will be provided in the panels where desired.

The panels may be treated for aesthetics as desired. Various exterior aesthetic treatments include siding, paneling, shingling, providing a stone or masonry facade, etc. The attachement of these architectural elements is very easy due to the fact that the resin-glass fiber composite can withstand the forces of nailing, riveting, etc. without cracking. The resin-glass fiver composite is also self-trapping. Traditional interior architectural elements include hardwood floors, tile, carpets, wallpaper, paneling, acoustical ceiling tiles, etc. Alternatively, the panels may be utilized as they come finished from the molds where the desired pigments and low profile additives have been incorporated in the resin-glass fiber composite.

The building panels according to the present invention have the following advantageous characteristics: moderate cost, high strength to weight ratio, excellent dimensional structural stability, excellent thermal properties, excellent sound insulation properties, good fire retardancy, good dielectric properties, excellent resistance to hydrostatic pressures and capillary moisture absorption, excellent resistance to chemicals and alkalis, and excellent resistance to abrasion, scratching and impact.

By using the panels according to the present invention in building structures, the following typical and frequently costly elements of structures may become obsolete: termite, rodent and other pest control; rot-proofing treating; damp-proofing and waterproofing treatments; floor joists, bridging and other typical underlayments; exterior wood framing; ceiling and roof rafters; wall and roof sheathing and necessary flashings, separate insulation precesses; plasterboard or drywall for lining the inside of the walls and ceiling of the building; and duct work for heating, cooling and the like. In addition, the amount of nails and other fasteners presently used in framing, rafters, etc. may be reduced, as may the amount of lumber required in present structures.

The present invention may be embodied in other specific forms without departing from the spirit or essential attributes thereof and, accordingly, reference should be made to the appended claims, rather than to the foregoing specification as indicating the scope of the invention.

What is claimed is:

1. A construction panel comprising a core of foamed polyurethane having a density of at least 4 pounds per cubic foot embodied between first and second major face members made of polyester resin reinforced with glass fibers in multidirectional orientation, pultrusion angle members encapsulated within said panel, said pultrusion angle members comprising side walls of said panel, said side walls having a portion extending beyond the plane of one of said major faces, said extending portion having a plurality of holes therethrough to facilitate connecting said panels to each other, and at least one elongated pultrusion reinforcing member disposed within said panel between said major face members and bonded to said major face members, said pultrusion reinforcing member being U-shaped in cross section to define a channel between the side walls of the reinforcing member, said pultrusion angle members and said pultrusion reinforcing member being prestressed and made of polyester resin reinforced with continuous strands of glass fibers in unidirectional orientation, said glass fibers used to reinforce said major face members having portions extending from the inner surface of said major face members into the interior of said panel whereby a mechanical and chemical bond is formed between said core and said major face members.

2. A construction panel comprising a core of foamed polymeric material embodied between first and second major face members made of resin reinforced with glass fibers, and prestressed pultrusion angle members encapsulted within said panel, said pultrusion angle members made of resin reinforced with continuous strands of glass fibers in unidirectional orientation and said pultrusion angle members forming side walls of said panels.

3. A construction panel according to claim 2 further comprising an elongated pultrusion reinforcing member disposed within said panel between said major face members and bonded to said major face members, said pultrusion reinforcing member is U-shaped in cross section to define a channel between the side walls of the reinforcing member, said channel being free to said polymeric material.

4. A construction panel according to claim 2 further comprising two elongated pultrusion reinforcing members disposed within said panel between said major face members and bonded to said major face members, each pultrusion reinforcing member being U-shaped in cross-section to define channel, said U-shaped pultrusion reinforcing members being disposed to intersect each other, the side wall portions of one of said U-shaped reinforcing members being eliminated at the area of intersection with said other U-shaped reinforcing member to provide intersecting channels free of said polymeric material, one of said pultrusion reinforcing members extending across the length of said panel, and the other of said pultrusion reinforcing members extending across the width of said panel.

5. A construction panel according to claim 2 wherein said pultrusion angle members are L-shaped in cross section.

6. a construction panel according to claim 2 wherein said pultrusion angle members are F-shaped in cross section.

7. A construction panel according to claim 2 wherein said glass fibers used to reinforce the resin forming said major face members are in multidirectional orientation.

8. A construction panel according to claim 7 wherein a portion of said reinforcing glass fibers in multidirectional orientation extend from the inner surface of said major face members into the interior of said panel whereby a mechanical and chemical bond is formed between said core of foamed polymeric material and said major face members.

9. A construction panel according to claim 2 wherein said resin used to make said pultrusion angle members is a polyester resin.

10. A construction panel according to claim 2 wherein said foamed polymeric material is foamed polyurethane.

11. A construction panel according to claim 10 wherein said foamed polyurethane has a density of at least 4 pounds per cubic foot.

12. A construction panel according to claim 2 wherein said side walls have a portion extending beyond the plane of one of said major face members, said portion including a plurality of holes adapted to receive fasterners for securing the panels together.

13. A building having its floors, walls and roof formed from panels according to claim 2.

* * * * *